United States Patent [19]

Rametsteiner et al.

[11] Patent Number: 4,960,164

[45] Date of Patent: Oct. 2, 1990

[54] METHOD OF CONTINUOUSLY CASTING A THIN STRIP

[75] Inventors: Hermann Rametsteiner, Dornach; Karl Schwaha, Linz; Franz Hirschmanner, Linz; Heinz Bramerdorfer, Linz, all of Austria

[73] Assignee: Voest-Alpine Industrieanlagenbau Gesellschaft m.b.h., Austria

[21] Appl. No.: 296,533

[22] Filed: Jan. 12, 1989

[30] Foreign Application Priority Data

Jan. 26, 1988 [DE] Fed. Rep. of Germany ..... 3802202

[51] Int. Cl.[5] ..... B22D 11/06

[52] U.S. Cl. ..... 164/480; 164/428; 164/488

[58] Field of Search ..... 164/480, 488, 428, 489

[56] References Cited

U.S. PATENT DOCUMENTS

| | | | |
|---|---|---|---|
| 2,450,428 | 10/1948 | Hazelett | 164/428 |
| 2,693,012 | 11/1954 | Harris et al. | 164/480 |
| 3,817,317 | 6/1974 | Gilmore | 164/428 |
| 4,771,819 | 9/1988 | Toyama et al. | 164/428 |
| 4,790,368 | 12/1988 | Kusakawa et al. | 164/428 X |

FOREIGN PATENT DOCUMENTS

| | | | |
|---|---|---|---|
| 331435 | 11/1975 | Austria . | |
| 0040072 | 11/1981 | European Pat. Off. . | |
| 0154250 | 9/1985 | European Pat. Off. . | |
| 58-209451 | 12/1983 | Japan | 164/480 |
| 59-97743 | 6/1984 | Japan | 164/480 |
| 61-229445 | 10/1986 | Japan | 164/480 |

*Primary Examiner*—Richard K. Seidel
*Assistant Examiner*—J. Reed Batten, Jr.
*Attorney, Agent, or Firm*—Handal & Morofsky

[57] ABSTRACT

When continuously casting a thin strip, metal melt is cast onto the drum surface of a first casting drum. A casting gap is formed by a second casting drum spaced apart with its drum surface from the first casting drum by the thickness of the strip. Strand shells form on the drum surfaces of the first and second casting drums. In order to enable the casting of strips having different thicknesses, a sump is formed at a distance from the cast-on site of metal melt on the drum surface of the first casting drum. Between the sump and the cast-on site on the drum surface of the first casting drum, a strand shell of a predetermied thickness is formed. The casting gap is adjusted in a position on the circumference of the first casting drum such that the two strand shells formed on the drum surfaces in terms of their maximum thickness, in total, correspond at least the thickness of the cast strip.

8 Claims, 2 Drawing Sheets

METHOD OF CONTINUOUSLY CASTING A THIN STRIP

The invention relates to a method of continuously casting a thin strip or a thin slab, in particular, of steel, having a thickness of between 1 and 20 mm, by casting metal melt onto the drum surface of a first casting drum, by forming a casting gap by means of a second casting drum spaced apart with its drum surface from the first casting drum by the thickness of the strip or of the strand, strand shells forming on the drum surfaces of the first and second casting drums upon contact with the metal melt and formation of a sump between the two casting drums, and by conveying the strand shells thus forming on the drum surfaces of the two casting drums, by rotation of the first and second casting drums, as well as to an arrangement for carrying out the method, which arrangement comprises

- two casting drums defining a casting gap therebetween,
- a supporting framework, which is pivotable about the axis of the first casting drum by a pivot means and in which the second casting drum is rotatably journaled,
- a vessel which is adjustable to the first casting drum with its pouring spout, and
- limit means laterally covering the casting gap between the first and second casting drums.

From EP-A No. 0 154 250, a method and a continuous casting arrangement of this type are known, by which thin strips or thin slabs can be produced. There, the second casting drum is provided immediately at the cast-on site of the melt on the first casting drum such that the liquid sump forming between the casting drums is present directly at the cast-on site. The first casting drum, along its circumference, is surrounded by a row of rollers in addition to the second casting drum, which serve to guide and cool the cast strand. The supply of melt in that case is effected on the upwardly moving side of the rotating first drum. The strand still has a liquid core over the major portion of the circumference of the first casting drum. The fact that the liquid core extends over the first casting drum calls for an expensive construction of the known arrangement, since the strand must be supported and guided with particular care in that region.

Besides, there is the problem of providing a sufficiently large ferrostatic pressure on the upwardly moving side of the first casting drum in order to maintain the cavity present within the strand shell filled with liquid melt, in particular, in the part of the strand moving upwardly. This involves the danger of a strand breakthrough with the uncontrolled emergence of melt.

To produce very thin strips—with the amorphous solidification of the metal—it is known from EP-B—0 040 072 to let the molten metal come into contact with a casting drum only by a thickness by which the immediate complete solidification of the metal layer on the casting drum surface is ensured. Thus, the thickness depends the circumferential speed of the casting drum and on the metallurgic properties of the melt. A strip of a somewhat larger thickness, i.e., in the range of between 1 and 20 mm, would require too strong a cooling effect and too long a cooling path to ensure the immediate complete solidification and, therefore, cannot be produced by such an arrangement.

In AT-B—331,435 it is described to apply melt onto a rotating casting drum. Also in that case, the complete solidification of the metal strip must occur on the upwardly moving part of the casting drum immediately upon contacting the surface of the casting drum. Thereby, only extremely thin strips of aluminum can be produced. The thickness of the strips largely depends on the depth of the melt bath on the site of transition to the drum surface.

The invention aims at avoiding these disadvantages and has as its object to provide a method as well as an arrangement for carrying out the method, of the intially described kinds, which enable the production of a strip having a thickness of between 1 and 20 mm with a high operational safety for various metal and steel grades and different strip thicknesses, the strip having exactly the desired thickness.

In accordance with the invention, this object is achieved in that the sump is formed at a distance from the cast-on site of metal melt on the drum surface of the first casting drum, that between the sump and the cast-on site on the drum surface of the first casting drum a strand shell of a predetermined thickness is formed, and that the casting gap is adjusted in a position on the circumference of the first casting drum such that the two strand shells formed on the drum surfaces in terms of their maximum thickness, in total, correspond at least the thickness of the cast strip or cast slab.

An arrangement of the initially defined kind for carrying out the method is characterized in that the pouring spout abuts on the circumferential side of the first casting drum facing away from the second casting drum.

To adjust different strip thicknesses, the bearing means of the second casting drum in the supporting framework advantageously is movable by an adjustment means in the direction towards and away from the bearing means of the first casting drum.

Suitably, the pivot means comprises a threaded spindle engaging at the supporting framework.

A preferred embodiment is characterized in that the pivot means comprises an elastically deformable tension means fastened to the supporting framework at a distance from the axis of the first casting drum, which is actuatable by means of a pressure medium cylinder.

Suitably, the pouring spout is equipped with an overflow weir and the level of the meniscus of the melt within the vessel is adjustable relative to the overflow weir.

To adjust a uniform strip width, the limit means advantageously are each formed by a plate that is pressable laterally at the end sides of the casting drums by an adjustment means.

According to a preferred embodiment, the limit means are each formed by a continuous belt that is pressable at the end sides of the casting drums by means of a pressing plate, the limit means suitably being provided with cooling means.

To change the width of the casting gap, advantageously at least one limit means is formed by a plate matching with the drum surfaces of the casting drums and displaceable along the same by an adjustment means.

Preferably, the supporting framework is pivotable by about 80° by moving the casting gap from the horizontal into a position inclined thereto by about 80°.

For larger strip widths, an induction means suitably is arranged between the pouring spout and the apex of the first casting drum or between the apex of the first casting drum and the casting gap.

The invention will now be explained in more detail with reference to the accompanying drawings, wherein.

Figure 1:
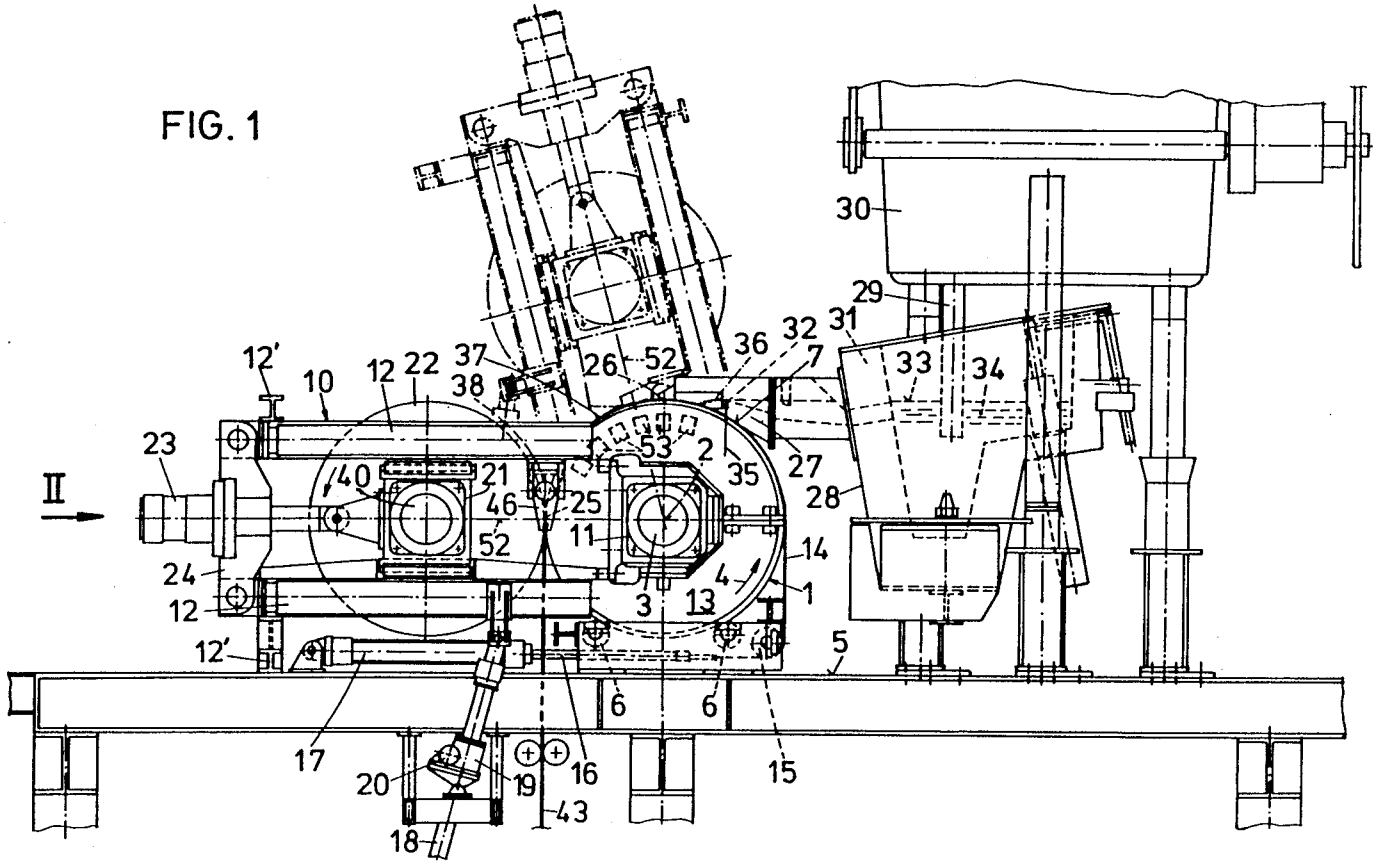
FIG. 1 is a schematic side view of a first continuous casting arrangement.

The continuous casting arrangement comprises a first casting drum 1 provided with internal cooling means (not illustrated), which is rotatably journaled about a horizontal axle 2 and drivable in the direction of the arrow 4 by a driving means 3. Mounting of the axle 2 on the casting platform 5 is effected via supporting rollers 6 rotatably journaled on the casting platform 5.

A supporting framework 10 engages at either of the two end sides 8, 9 of the first casting drum 1 and is pivotable about the axle 2 of the first casting drum 1 by means of bearings 11. The supporting framework 10 includes frames 12 located at either end side 8, 9 of the first casting drum 1 and extending radially away from the axle 2 of the first casting drum 1. The frames each verge into a disk-shaped end piece 13 arranged concentrically with the first casting drum 1 and resting on two of the supporting rollers 6. The frames 12 are rigidly interconnected by means of cross beams 12' to form the supporting framework 10. A flexible tension means, for instance, a strap 14 or a rope, externally engages at each end piece 13, which tension means is guided over a deflection pulley 15 rotatably mounted on the casting platform 5 and, with its end, is fastened to the piston rod 16 of a pressure medium cylinder 17. The pressure medium cylinder 17 is hinged to the casting platform 5. Upon actuation of this pressure medium cylinder 17, the supporting framework 10, together with the frames 12, thus, may be pivoted about the axle 2 of the first casting drum 1 into the position illustrated in dot-and-dash lines in FIG. 1.

To assist this pivotal movement, a threaded spindle 18 is provided for each frame 12, engaging at the frame 12 with one end. A nut 19 articulately arranged on the casting platform 5 and penetrated by the threaded spindle 18 serves to drive the threaded spindle 18. The nut is drivable by means of a worm gear 20.

The frames 12 of the supporting frameworks 10 serve to accommodate one bearing means 21 each, of a second casting drum 22, which bearing means 21 are displaceable in the direction towards the first casting drum 1 or in the opposite direction by means of pressure medium cylinders 23, each being supported on an end-side crosshead 24 of the frames 12. Thereby, it is possible to adjust a casting gap 25 of a predetermined size between the two casting drums 1 and 22.

A pouring spout 27 of a tundish 28 may be set at the drum surface 7 of the first casting drum 1 moving upwardly upon rotation of the first casting drum 1, closely below the apex 26. An immersed tube 29 of a casting ladle 30 positioned above the tundish 28 reaches into the tundish 28. The tundish 28 and the pouring spout 27 are lined with refractory material 31. The pouring spout 27 is equipped with an overflow weir 32.

The level 33 of the metal melt 34 poured into the tundish 28 is at the height 35 of the overflow weir 32 such that a thin film 36 of metal melt 34 will flow over the overflow weir 32 onto the drum surface 7 of the first casting drum 1. Solidification of a part of the metal melt occurs on the casting drum 1 with a strand shell 37 forming, which increases in thickness over the circumference of the casting drum. A part of the still liquid metal melt flows as far as into the casting gap 25 formed by the two casting drums 1 and 22, creating a liquid sump 38 on account of a material back-up.

On the drum surface of the second casting drum 22, a further strand shell 39 forms, which is moved to the casting gap 25 by rotating the second casting drum 22 in a direction opposite to the first casting drum 1 and at the same or at a slightly deviating circumferential speed by means of a drive 40. The casting gap 25, in terms of its thickness 41, corresponds to the thickness 42 of the strip 43 withdrawn. The position of the casting gap 25 and the cooling effect of the casting drums (even the second casting drum may be provided with internal cooling means) are chosen such that the thicknesses 44, 45 of the strand shells 37, 39 formed on the casting drums 1 and 22, at the site of the casting gap 25, in total correspond to at least the thickness 42 of the strip 43 withdrawn. Thereby, it is ensured that the withdrawn strip 43 no longer has a liquid core and the support of the strip 43 upon withdrawal from the casting drums 1 and 22 is necessary only for guiding the same.

Figure 2:
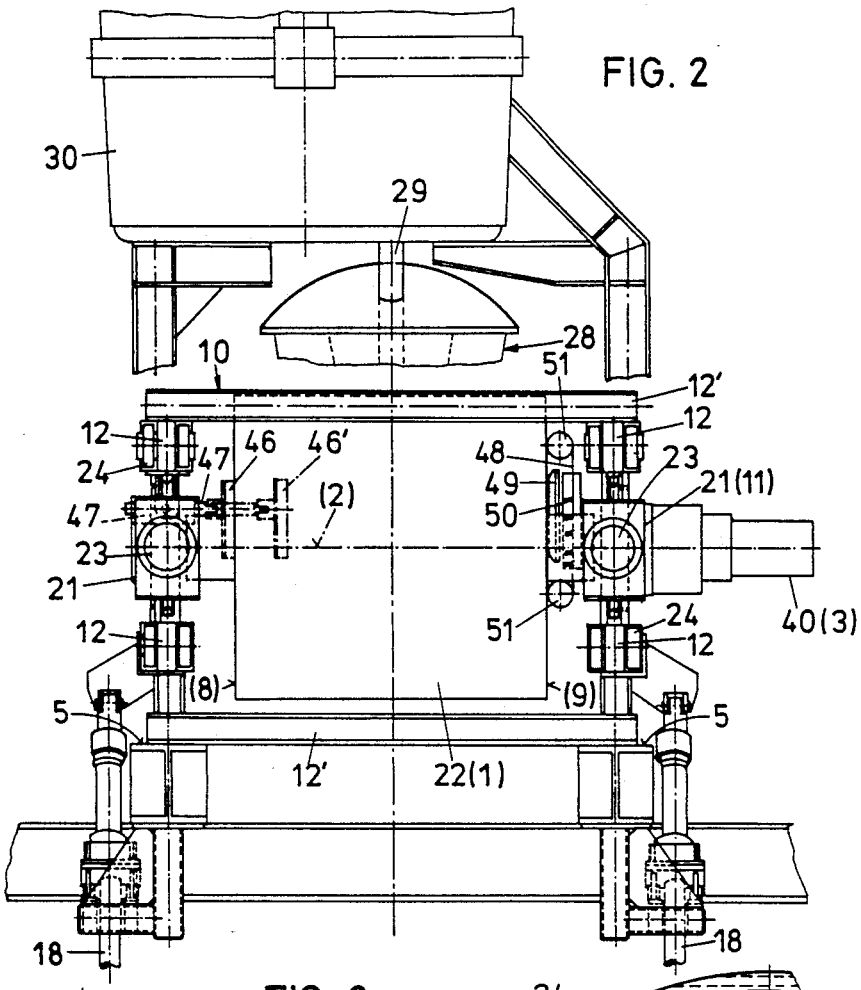
FIG. 2 is a partially sectioned view in the direction of the arrow II of FIG. 1.
Figure 3:
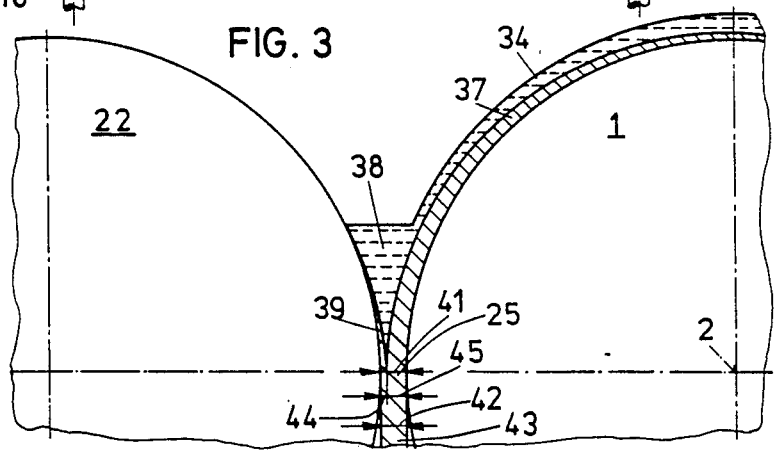
FIG. 3 illustrates a detail of FIG. 1.

As is illustrated on the left-hand side of FIG. 2, the lateral limitation of the casting gap 25 may be realized by an optionally cooled plate 46, which is pressable at the end surfaces of the casting drums 1 and 22 in the region of the casting gap 25 and which plate slidingly contacts one end side each of the casting drums 1 and 22. A pressing cylinder 47 is articulately fastened to the frame 12 of the supporting framework 10 to press the plate 46 towards the end sides.

An embodiment of laterally delimiting the casting gap, which is illustrated on the right-hand side of FIG. 2, comprises a circulating continuous belt 48, which is pressed at the end sides of the casting drums 1 and 22 in the region of the casting gap 25 by means of a pressing plate 49. The belt 48 circulates at approximately the circumferential speed of the casting drums 1 and 22. Thereby, too intensive sliding between the end sides of the casting drums 1 and 22 and the limitation means is avoided. A cooling means 50 for the belt is schematically illustrated in FIG. 2. The deflection pulleys 51 of the belt 48 are fastened to the frame 12 of the supporting framework 10.

It is essential to the functioning of the continuous casting arrangement that the position of the supporting framework 10 and its frames 12 be adjusted in a manner that the thicknesses of the strand shells 37, 39 formed on the surfaces of the casting drums in the casting gap 25, in total, correspond to at least the thickness 42 of the final strip. In order to ensure this for various strip thicknesses and metals and metal alloys or casting speeds, the frames 12 are adapted to be inclined, with their longitudinal axes 52, by about 80° relative to the horizontal line, as is illustrated in FIG. 1 by dot-and-dash lines. This means that the plane of connection of the axles of the two casting drums 1 and 22 may be placed from the horizontal plane into a position inclined by about 80° relative to the same.

In order to guarantee the synchronous movement of the metal melt 34 with the strand shell 37 solidified on the surface of the first casting drum 1, induction means 53 may be arranged within the first casting drum 1, which, suitably, are provided stationarily and may be set into operation in dependence on the length over which the liquid metal melt 34 extends on the surface of the first casting drum.

What is claimed is:

1. A method of continuously casting a thin continuous, metal member of substantially uniform width in an arrangement including a first casting drum rotating about a first axis, said first casting drum having a first casting drum surface, and a second casting drum rotating about a second axis, said second casting drum having a second casting drum surface, said second casting drum surface spaced apart from said first casting drum surface by substantially a uniform thickness of said metal member, comprising the steps of:

(a) casting metal melt onto said first casting drum surface at a cast-on site, (b) forming a casting gap between said first casting drum surface and said second casting drum surface, (c) forming a sump between said first casting drum and said second casting drum at an adjustable distance from the cast-on site of said metal melt, said distance being adjustable by pivoting said second casting drum about said first axis, (d) allowing a first strand shell to form on said first casting drum surface between said sump and said cast-on site and a second strand shell to form on said second casting drum surface, upon contact with said sump, and (e) adjusting the position of said casting gap to a position on the circumference of said first casting drum such that the maximum thickness of said first and second strand shells, in total, corresponds to at least the thickness of said cast member, wherein said first and second strand shells formed on said first and second casting drum surfaces are conveyed to said casting gap by the rotation of said first and second casting drums.

2. A method as claimed in claim 1, wherein said metal melt is cast onto said first casting drum on a circumferential side, with respect to a vertical axis passing through said first casting drum facing away from said second casting drum.

3. A method as claimed in claim 1, wherein said casting gap is positioned at an angle approximately 80° inclined from a horizontal positioning of said two drums.

4. A method as claimed in claim 1, wherein said casting gap has a position, relative to said first casting drum, that is adjustable such that said second casting drum is moved between a position horizontal with said first casting drum and a position approximately 80° inclined from the horizontal.

5. A method as claimed in claim 1, further comprising the step of providing induction through induction means arranged between said cast-on site and said casting gap.

6. A method as claimed in claim 1, further comprising the step of cooling said first casting drum.

7. A method of continuously casting a thin continuous, metal member, in an arrangement including a first rotating casting drum having a first casting drum surface and a second rotating casting drum having a second casting drum surface spaced apart from said first casting drum surface by substantially the thickness of said metal member, which method comprises:

casting metal melt onto said first casting drum surface thus constituting a cast-on site, forming a casting gap between said first casting drum surface and said second casting drum surface, forming a sump between said first casting drum and said second casting drum at an adjustable distance from said cast-on site of said metal melt, allowing a first strand shell to form on said first casting drum surface between said sump and said cast-on site and a second strand shell to form on said second casting drum surface, upon contact with said sump, and adjusting the position of said casting gap with respect to the cast-on site such that the maximum thickness of said first and second strand shells, in total, corresponds to at least the thickness of said cast member, wherein conveying said first and second strand shells formed on said first and second casting drum surfaces are conveyed to said casting gap by the rotation of said first and second rotating casting drums.

8. A method of continuously casting a thin continuous, metal member, in an arrangement including a first rotating casting drum having a first casting drum surface and a second rotating casting drum having a second casting drum surface spaced apart from said first casting drum surface by substantially the thickness of said metal member, which method comprises:

casting metal melt onto said first casting drum surface thus constituting a cast-on site, said cast-on site being positioned on the side of said first casting drum opposite the side of said first casting drum that faces said second casting drum, forming a casting gap between said first casting drum surface and said second casting drum surface, forming a sump between said first cating drum and said second casting drum at an adjustable distance from said cast-on site of said metal melt, and allowing a first strand shell to form on said first casting drum surface between said sump and said cast-on site and a second strand shell to form on said second casting drum surface, upon contact with said sump, wherein said first and second strand shells formed on said first and second casting drum surfaces are conveyed to said casting gap by the rotation of said first and second rotating casting drums.

* * * * *